US006337673B1

(12) United States Patent
Ide et al.

(10) Patent No.: US 6,337,673 B1
(45) Date of Patent: Jan. 8, 2002

(54) DRIVING PLASMA DISPLAY DEVICE

(75) Inventors: Shigeo Ide; Hiroyuki Ajiki, both of Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/348,343

(22) Filed: Jul. 8, 1999

(30) Foreign Application Priority Data

Jul. 29, 1998 (JP) ..... 10-214490

(51) Int. Cl.[7] ..... G09G 5/00
(52) U.S. Cl. ..... 345/60; 345/208
(58) Field of Search ..... 345/208, 210, 345/60, 61, 68

(56) References Cited

U.S. PATENT DOCUMENTS 4,684,849 A * 8/1987 Otsuka et al. ..... 315/169
5,952,986 A * 9/1999 Nguyen ..... 345/68
6,097,357 A * 8/2000 Shinoda et al. ..... 345/63
6,115,011 A * 9/2000 Sano et al. ..... 345/64
6,160,530 A * 12/2000 Makino ..... 345/60
6,195,070 B1 * 2/2001 Shinoda et al. ..... 345/60
6,198,476 B1 * 3/2001 Hong et al. ..... 345/204

* cited by examiner

*Primary Examiner*—Bipin Shalwala
*Assistant Examiner*—Nitin Patel
(74) *Attorney, Agent, or Firm*—Sughrue Mion, PLLC

(57) ABSTRACT

A plasma display device for producing a display using an address period in which paired row electrodes are applied with a scan pulse, and column electrodes are simultaneously applied with pixel data pulses to select light emitting pixels and non-light emitting pixels, and a discharge sustaining voltage in which the paired row electrodes are applied with a sustain pulse to sustain a sustaining discharge for light emitting pixels and non-light emitting pixels, wherein the sustain pulse has a waveform exhibiting gentle rising or falling at a leading edge thereof, as compared with the scan pulse, and the sustaining discharge is limited in a region near a discharge gap formed between paired row electrodes within a unit light emitting region.

8 Claims, 12 Drawing Sheets

DRIVING PLASMA DISPLAY DEVICE

BACKGROUND OF THE INVENTION

1. Field of the Invention

The present invention relates to a plasma display device and a method for driving the same.

2. Description of the Related Art

A plasma display device has been implemented as one type of thin two-dimensional screen display device. A matrix-type surface discharge AC plasma display panel having a memory function is known as one of plasma display devices.

Almost of surface discharge AC plasma display panels employ a three-electrode structure. In this type of plasma display panel, two substrates, i.e., a front glass substrate and a back glass substrate are positioned opposite to each other with a predetermined gap intervening therebetween. On an inner surface (i.e., a surface opposite to the back glass substrate) of the front glass substrate serving as a display plane displaying an image, a plurality of paired row electrodes extending in parallel are formed as paired sustain electrodes. On the back glass substrate, a plurality of column electrodes intersecting with the paired row electrodes are formed to extend as address electrodes, and a fluorescent material is coated overlaying the column electrodes. Between the front substrate and the back substrate airtightly sealed, when viewed from the display plane, cells, i.e., unit light emitting regions each corresponding to a pixel or a light emitting cell are formed in a matrix form, each centered on the intersection of the paired row electrodes and a column electrode. In one cell, a gap between the row electrodes or the transparent electrodes near the intersection functions as a discharge gap. The row electrodes and the column electrodes may be referred to as "discharge electrodes."

FIG. 1 illustrates the configuration of a driver for driving a plasma display panel 120 which comprises column electrodes D1 to Dm connected to a pixel data pulse generator circuit 212, and paired row electrodes X1, Y1 to Xn, Yn connected to a row electrode driving pulse generator circuit 210.

Referring specifically to FIG. 1, a synchronization separating circuit 201 extracts horizontal and vertical synchronization signals from an input video signal supplied thereto, and supplies a timing pulse generator circuit 202 with the extracted synchronization signals. The timing pulse generator circuit 202 generates an extracted synchronization signal timing pulse based on the extracted horizontal and vertical synchronization signals, and supplies this timing pulse to an A/D converter 203, a memory control circuit 205 and a read timing signal generator circuit 207, respectively. The A/D converter 203 converts the input video signal to digital pixel data corresponding to each pixel in synchronism with the extracted synchronization signal timing pulse, and supplies the digital pixel data to a frame memory 204. The memory control circuit 205 supplies the frame memory 204 with a read signal and a write signal in synchronism with the extracted synchronization signal timing pulse. The frame memory 204 sequentially fetches respective pixel data supplied from the A/D converter 203 in response to the write signal. Pixel data stored in the frame memory 204 is sequentially read therefrom in response to the read signal and supplied to an output processing circuit 206 at the next stage. The read timing signal generator circuit 207 generates a variety of timing signals for controlling a discharge light emission operation, and supplies these timing signals to the row electrode driving pulse generator circuit 210 and to the output processing circuit 206. The output processing circuit 206 supplies the pixel data pulse generator circuit 212 with pixel data supplied from the frame memory 204 in synchronism with a timing signal from the read timing signal generator circuit 207.

The pixel data pulse generator circuit 212 generates a pixel data pulse DP corresponding to each of pixel data supplied from the output processing circuit 206, and applies the pixel data pulse DP to the column electrodes D1–Dm of the plasma display panel 120.

The row electrode driving pulse generator circuit 210 generates first and second predischarge pulses for performing a predischarge between all pairs of row electrodes X1, Y1 to Xn, Yn in the plasma display panel 120, a priming pulse for re-forming charged particles, a scan pulse for writing pixel data, a sustain pulse for sustaining a discharge for emitting light in accordance with pixel data, and an erasure pulse for stopping the discharge sustained for light emission. The row electrode driving pulse generator circuit 210 supplies to the row electrodes X1–Xn and Y1–Yn of the plasma display panel 120 with these pulses at timings corresponding to a various types of timing signals supplied from read timing signal generator circuit 207.

The row electrode driving pulse generator circuit 210 includes an X-driver for generating a sustain pulse for the row electrodes X1 to Xn, and a Y-driver for generating a sustain pulse for the row electrodes Y1 to Yn.

For driving a surface discharge AC plasma display panel having a plurality of pixel cells formed in matrix, it is necessary to select whether or not each pixel cell is to emit light in each sub-frame. In this event, for providing a uniform difference in light emitting condition between pixel cells due to the difference in data for images to be displayed in each sub-frame, and also for stabilizing a discharge when writing data, a rectangular reset pulse is applied between row electrodes of the paired row electrodes to initialize all cells by the action of a reset discharge caused by the application of reset pulse. Next, a rectangular scan pulse is applied to the column electrodes selected in accordance with data to cause selective discharges between the selected column electrodes and associated row electrodes to write data into corresponding pixel cells.

In the initialization of and the data write into pixel cells, there are two possible processes. First, selective writing is performed for selecting pixel cells, from which light is to be emitted, by previously generating a constant amount of wall charges in all pixel cells by the reset discharge and increasing the wall charges in the pixel cells by a so-called selective discharge using a scan pulse applied to selected column electrodes. Second, a selective erasure is performed for selecting pixel cells to be maintained unlit by extinguishing wall charges in the pixel cells by a selective discharge. Subsequently, a sustain pulse is applied to produce a sustaining discharge for maintaining emitted light in selected pixel cells during the selective write or to produce a sustaining discharge for maintaining emitted light in non-selected pixel cells during the selective erasure. Further, after a predetermined time has elapsed, data written in pixel cells is erased by applying erasure pulses to the pixel cells in any data write.

FIG. 2 conceptually illustrates the configuration of an X-driver 210X and a Y-driver 210Y in a row electrode driving pulse generator circuit 210. Referring specifically to FIG. 2, the pulse generator circuit 210 comprises a sustain voltage source Vs; switches SW1–SW5 such as FETs; a charge recovering capacitor CK; coils LK1, LK2; and diodes D1, D2 each for regulating a current to flow in a single direction. In this configuration, a series resonance circuit is formed of the capacitor CK and the coil LK1 or LK2.

A driving method for generating a sustain pulse to row electrodes X1–Xn by the X-driver 210X will now be described with reference also to FIGS. 3A and 3B. FIG. 3A illustrates the charging voltage waveform of a sustain pulse applied to a row electrode, and FIG. 3B illustrates a change in the luminance of emitted light from an associated cell. Assume that a charge has been sufficiently recovered to the capacitor CK from a panel after the switch SW2 has been turned ON and the remaining switches have been turned OFF after application of the preceding sustain pulse. First, the switch SW5 is turned ON and the remaining switches are turned OFF to reduce the potentials at all of the row electrodes X1–Xn to the ground potential. Next, the switch SW1 is turned ON and the remaining switches are turned OFF at timing T1, causing the charge on the capacitor CK to be supplied to the row electrodes X1–Xn through the coil LK1 and the diode D1. Thus, charging is started on all of the row electrodes X1–Xn with the charge on the capacitor CK forming part of the series resonance circuit. Then, as the switch SW4 is turned ON and the remaining switches are turned OFF at timing T2 after a predetermined time during which it is expected that the panel exhibits a maximally charged voltage (ideally, a quarter wavelength of the resonance frequency), the row electrodes X1–Xn are supplementarily supplied with charges such that they hold the sustain pulse which has a voltage raised to the voltage of the sustain voltage source Vs. In this way, the charge of the panel previously recovered on the capacitor CK can be used to previously charge the panel for the next time. As illustrated in FIG. 3A, timing T3 indicates a start timing for turning the switch SW2 ON to recover a charge of the panel to the capacitor CK, and timing T4 indicates a start timing for turning the switch SW5 ON to switch to the ground potential. The duration between the timings T3 and T4 may be given by a predetermined time Tα' similar to Tα.

As described above, in the conventional driving method for generating a sustain pulse to the row electrodes X1–Xn through the X-driver 210X, the voltage waveform of the sustain pulse for minimizing the power is generated as a rectangular pulse having abrupt rising and falling edges between timings T1 and T4. More specifically, as illustrated in FIG. 3A, the switch SW1 is turned ON at timing T1 to start rapid charging of the panel with a recovered charge on the capacitor CK, and the switch SW1 is turned OFF and the switch SW4 is turned ON to switch a charged voltage to the constant voltage source Vs, thus continuously charging the panel at timing T2 after a predetermined time Tα during which a peak voltage $V_{CHG}$ available from the series resonance circuit is reached. Thus, as illustrated in FIG. 3B, the luminance of light emitted from a plurality of cells increases substantially simultaneously at timing T2. Likewise, a pixel data pulse, a scan pulse and an erasure pulse are each generated as a rectangular pulse having abrupt rising and falling edges.

OBJECT AND SUMMARY OF THE INVENTION

In the prior art, on the other hand, an opaque metal material is used for bus electrodes. Thus, when rectangular sustain pulses are applied so that the charging extends from the row electrodes or the transparent electrodes to bus electrodes, visible light generated within each cell of a panel is shielded by the bus electrodes in a greater ratio, thus resulting in a reduced light emitting efficiency. Also, as the applied voltage Vs of the sustain pulse is increased, the panel experiences a reduced light emitting efficiency.

To solve the problem of the reduction in light emitting efficiency, the applied constant voltage Vs generated by an external sustain voltage source for the sustain pulse is set near a minimal discharge sustaining voltage Vsm inherent to cells, as illustrated in FIG. 3A, in order to concentrate the discharge on edges of leading ends of opposing transparent electrodes to reduce the ratio of light shielded by the bus electrodes and accordingly improve the light emitting efficiency. Since power consumption is governed by a potential difference between the peak voltage $V_{CHG}$ and the constant voltage Vs, the power consumption can be reduced by minimizing this potential difference between the two voltages.

In this case, however, if the minimal discharge sustaining voltage Vsm inherent to cells largely varies with respect to the externally applied voltage Vs during a panel manufacturing process, a certain cell will fail to emit light if the externally applied voltage Vs does not reach a minimal discharge sustaining voltage Vsm' inherent to the cell, as illustrated in FIG. 3A, in spite of the externally applied voltage Vs which is set at a value equal to or higher and near a minimum value of minimal discharge sustaining voltage Vsm of a plurality of cells. As mentioned, the prior art driving method has a problem that stable light emission is hindered by variations in the discharge characteristic of each of cells constituting a panel.

Furthermore, in the prior art, the timing T2 (or T4) for switching a charged voltage $V_{CHG}$ to the constant voltage source is determined by a fixed time Tα(or Tα'), as illustrated in FIG. 3A. If variations in capacitance of cells in an overall panel cause the resonance frequency of a series resonance circuit to shift, for example, in a direction in which the timing Tα becomes smaller, the charged voltage $V_{CHG}$ is switched to the constant voltage source before it reaches a peak value of the resonance waveform due to the abrupt rising of the sustain pulse, causing an unstable potential difference between the charged voltage $V_{CHG}$ and the externally applied voltage Vs. This potential difference is difficult to minimize, and may also cause a problem of larger power consumption.

It is therefore an object of the present invention to achieve a plasma display device and a method for driving the same being capable that a stable micro-discharge at a lower voltage by optimizing the waveform of a sustain pulse applied to row electrodes and the structure of cells to improve a light emitting efficiency. It is another object of the present invention to stabilize light emitted from cells in spite of variations in the discharge characteristic of respective cells constituting the plasma display panel.

To achieve the above object, the present invention provides a plasma display device for displaying an image comprising:

a plasma display panel including a plurality of row electrodes formed in pairs and extending in parallel with each other in the horizontal direction, a plurality of column electrodes extending in the vertical direction and facing said paired row electrodes with a discharge space intervening therebetween to form unit light emitting regions at respective intersections with said paired row electrodes, and a dielectric layer for covering up said paired row electrodes with respect to said discharge space;

means for applying a scan pulse to every pair of row electrodes and simultaneously applying a pixel data pulse to every column electrode to select light emitting pixels and non-light emitting pixels during an addressing period; and means for applying a series of sustain pulses alternately to one of the row electrode pair and the other thereof to sustain discharges for said light emitting pixels and said non-light emitting pixels during a discharge sustaining period, wherein each of said sustain pulses has a waveform exhibiting gentle rising or falling at a leading edge thereof, as compared with said scan pulse, whereby limiting each of said sustaining discharges in a region near a discharge gap formed between paired row electrodes within said unit light emitting region.

In a plasma display device in an aspect of the invention, a protruding surface portion is formed on said dielectric layer to protrude relative to the remaining surface portion of said dielectric layer, said protruding portion being positioned on an edge portion of said row electrode on the side opposite to said discharge gap, whereby further limiting each of said sustaining discharges in a region near a discharge gap formed between paired row electrodes within said unit light emitting region.

In a plasma display device in another aspect of the invention, each of said row electrodes is formed with a width equal to or more than 300 $\mu$m within said unit light emitting region, whereby further limiting each of said sustaining discharges in a region near a discharge gap formed between paired row electrodes within said unit light emitting region.

In a plasma display device in another aspect of the invention, each of said paired row electrodes includes a main portion extending in the horizontal direction, and a protrusion protruding from said main portion in the vertical direction so as to face a protrusion of the other row electrode forming a pair, with a discharge gap intervening therebetween, in each of said unit light emitting regions, whereby further limiting each of said sustaining discharges in a region near a discharge gap formed between paired row electrodes within said unit light emitting region.

In a plasma display device in another aspect of the invention, said protrusions are formed such that said discharge gap is formed in the horizontal direction.

In a plasma display device in another aspect of the invention, said protrusions are formed such that said discharge gap is formed in the vertical direction.

In a plasma display device in another aspect of the invention, said regions of the respective row electrodes in said paired row electrodes near said discharge gap are formed opposite to each other face to face with said discharge space intervening therebetween, whereby further limiting each of said sustaining discharges in a region near a discharge gap formed between paired row electrodes within said unit light emitting region.

In a plasma display device in another aspect of the invention, said means for applying the sustain pulses comprises:

a DC power source for generating DC voltage having a positive side and negative side terminals;

a first capacitor connected in parallel with said DC power source;

a coil having a fist end connected to the positive side terminal of said DC power source and a second end opposite thereto;

switching means for alternately performing a connection and a disconnection between the second end of said coil and the negative side terminal of said DC power source;

a diode having a cathode connected to the second end of said coil and an anode connected to the negative side terminal of said DC power source; and a second capacitor connected in parallel with said diode, wherein said coil outputs the sustain pulse at the second end thereof in accordance with an operation of said switching means.

In a plasma display device in another aspect of the invention, a change rate of the voltage value gently increasing of said sustain pulse in said unit light emitting region is 50volts or less per microsecond.

In a plasma display device in another aspect of the invention, said sustain pulse which exhibits gradually rising is selected from a group composed of pulse waveforms having a saw-tooth wave, a triangular wave and a sinusoidal wave.

According to the present invention, a series of sustain pulses are applied the paired row electrodes to sustain discharges for light emission during a discharge sustaining period, wherein each of the sustain pulses has a waveform gradually or gently rising or falling at a leading edge thereof, as compared with the scan pulse, whereby limiting each of the sustaining discharges in a region near a discharge gap formed between paired row electrodes within the unit light emitting region. Therefor the plasma display device provides a more stabilized micro-discharge in all cells of the overall panel in the plasma display device, thereby making it possible to simultaneously improve a light emitting efficiency and ensure a display margin.

BRIEF DESCRIPTION OF THE DRAWINGS

The aforementioned aspects and other features of the invention are explained in the following description, taken in connection with the accompanying drawing figures wherein.

DESCRIPTION OF THE PREFERRED EMBODIMENTS

The preferred embodiments of a plasma display device and a method for driving the same according to the invention are described in detail referring to the accompanying drawings.

Figure 4A:
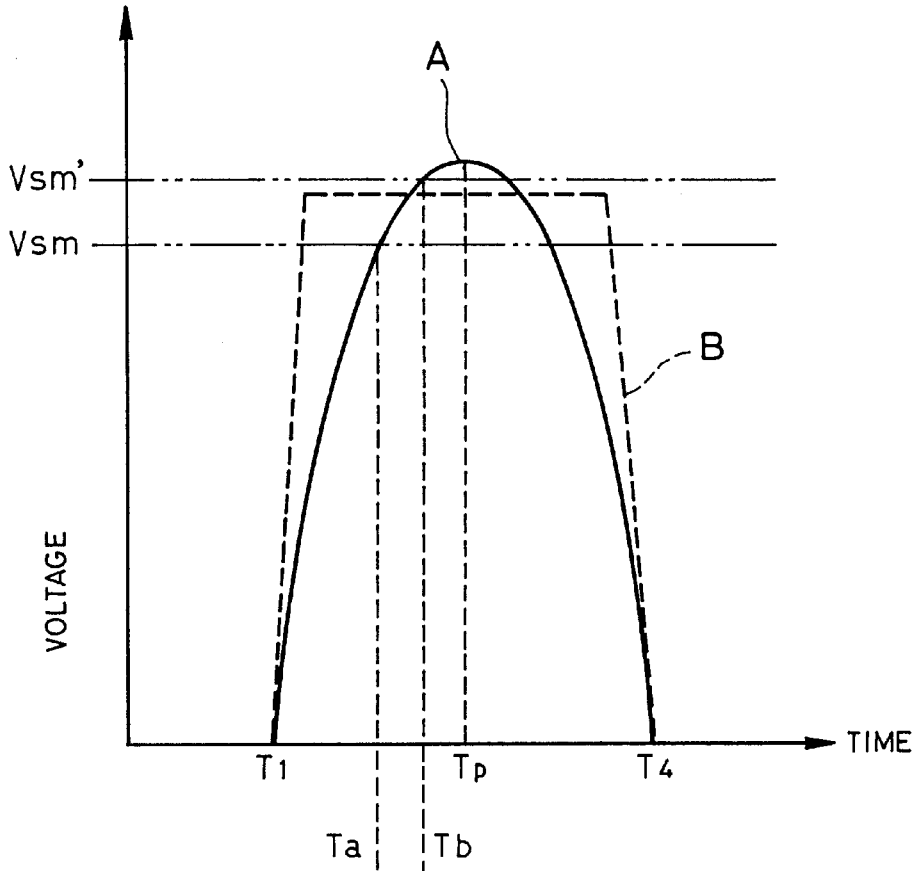
FIGS. 4A and 4B are diagrams illustrating a charging voltage waveform of a sustain pulse applied to a row electrode and two corresponding changes in the luminance of light emitted from different cells in a method of driving a plasma display device according to an embodiment of the present invention respectively.
Figure 4B:
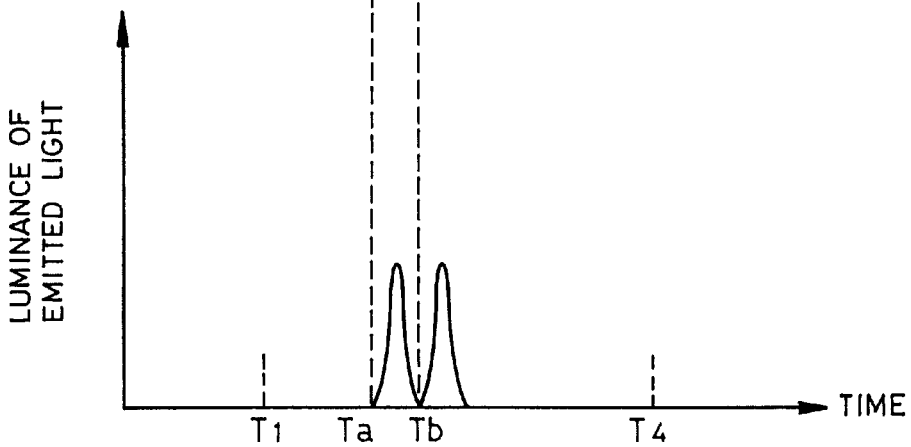

FIG. 4A illustrates the charging voltage waveform of a sustain pulse exhibiting rather gentle rising at a leading edge thereof, i.e., a sustain pulse applied to a certain row electrode in a method of driving a plasma display device according to an embodiment of the present invention, and FIG. 4B illustrates a corresponding change in the luminance of light emitted from an associated cell. In the method according to this embodiment of the present invention, as illustrated in FIG. 4A, a pulse exhibiting sufficiently gentle rising, for example, a sinusoidal fly-back pulse is applied to each row electrode as a sustain pulse "A" to cause a discharge near a minimal discharge sustaining voltage Vsm or Vsm', which may be different from cell to cell, in the middle of a rising stroke of the voltage. For comparison, a rectangular scan pulse exhibiting abrupt rising (or falling) is also illustrated by a broken line B in FIG. 4A. As can be seen, the sustain pulse "A" has a waveform which gently rises or falls at a leading edge as compared with the scan pulse B. In the unit light emitting region, a change rate of the voltage value gently or gradually increasing of the sustain pulse is 50 volts or less per microsecond. This enables all cells to emit light even with variations in the minimal discharge sustaining voltage Vsm inherent to respective cells. This is because, as illustrated in FIG. 4B, the sustain pulse reaches a variety of minimal discharge sustaining voltages Vsm, Vsm' inherent to different cells during a gentle rising period thereof to cause all cells to emit light within the single pulse illustrated, although the respective cells emit light at different light emitting timings.

Figure 5A:
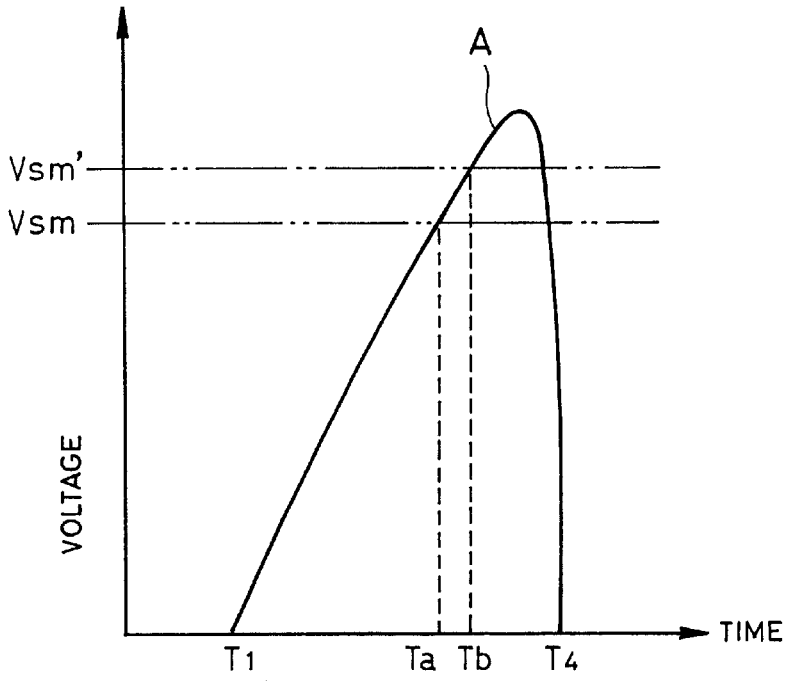
FIGS. 5A and 5B are diagrams each illustrating another charging voltage waveform of a sustain pulse applied to a row electrode in a method of driving a plasma display device according to another embodiment of the present invention.
Figure 5B:
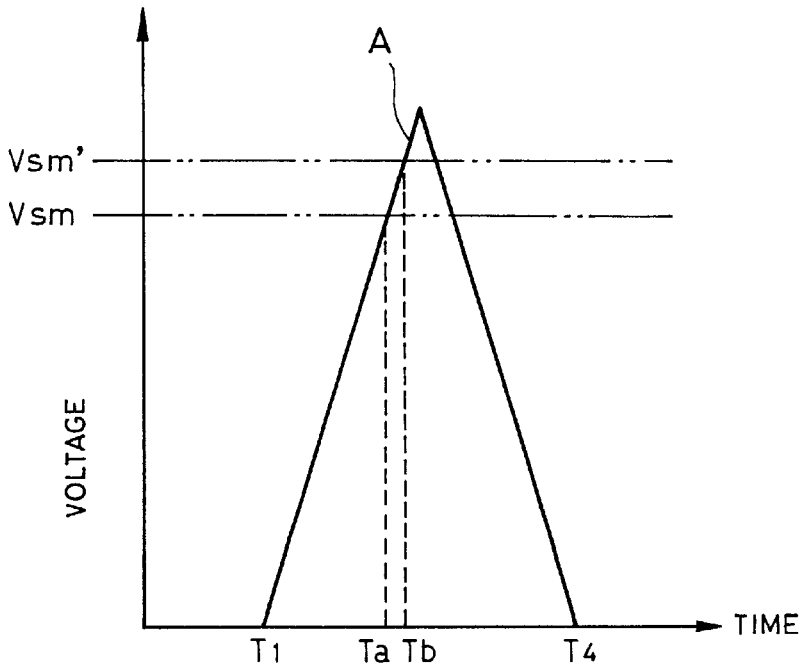

Alternatively, a saw-tooth wave (FIG. 5A) or a triangular wave (FIG. 5B) may also be used as the sustain pulse "A" which exhibits sufficiently gentle rising.

Figure 6:
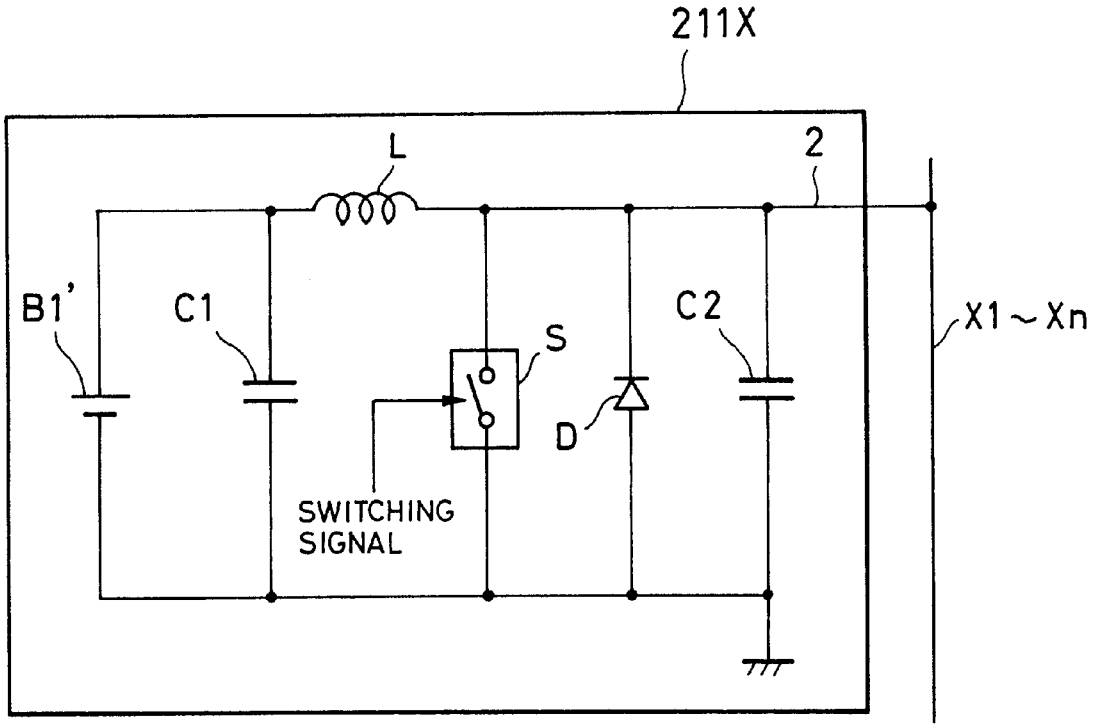
FIG. 6 is a schematic circuit diagram illustrating a row electrode driving pulse generator circuit in a driver for use with a plasma display device according to an embodiment of the present invention.

Description will be next made on a driving method of generating the sinusoidal fly-back pulse exhibiting sufficiently gentle rising, illustrated in FIG. 4A, based on an X-driver 211X appearing in FIG. 6.

The X-driver 221X illustrated in FIG. 6 is provided with a fly-back pulse output circuit. A direct-current (DC) power source B1 for generating a DC voltage has a negative pole connected to the ground potential of a panel. A first capacitor Cl is connected in parallel with the DC power source B1. The DC power source B1 has a positive pole connected to one end of a coil L, the other end of which is connected to row electrodes X1–Xn of the panel through a line 2. A switching device S connects and breaks a path between the other end of the coil L and the negative pole of the DC power source B1 in response to a switching signal supplied thereto from a driving control circuit 51. The X-driver 211X is further provided with a diode D which has a cathode terminal connected to the other end of the coil L and an anode terminal connected to the negative pole of the DC power source B1. A second capacitor C2 is connected in parallel with the diode D. The negative pole of the direct-current power source Bl, the switching device S, the anode terminal of the diode D, and one end of each of the capacitors C1, C2 are connected to the ground potential. The capacitor C1 has a capacitance sufficiently larger than the capacitance of the capacitor C2 and a load capacitance C0 possessed by the panel.

The operation of the foregoing fly-back pulse output circuit will next be described in brief. By turning ON and OFF the switching device S, a sinusoidal pulse as illustrated in FIG. 4A is generated by a series of alternate operations of resonance between the capacitor C1 and the coil L and resonance between the coil L and the capacitor C2 and the load capacitance C0 of the panel. The switching device S, responsive to the switching signal, connects the path between the other end of the coil L and the negative pole of the DC power source B1 at timing T1 shown in FIG. 4A, thereby allowing a sustain pulse to last until timing T4. At timings Ta, Tb in the middle, cells having minimal discharge sustaining voltages Vsm, Vsm' emit light as illustrated in FIG. 4B. The generated sinusoidal sustain pulse exhibiting gentle rising is repetitively applied to row electrodes through the line 2. It should be noted that since the DC power source B1 in the fly-back pulse output circuit disposed in the row electrode driving circuit 41 generates a voltage by making use of a self inductance between the coil L and the respective capacitances based on a change in the amount of current due to ON/OFF operations of the switching element S, the value of the voltage generated by the DC power source B1 may be lower than a peak value of the sinusoidal pulse. While the voltage peak of the fly-back pulse at time Tp, presenting a sufficiently gently rising sinusoidal wave illustrated in FIG. 4A, is set by the coil L and the capacitive components, the highest one of minimal discharge sustaining voltages Vsm inherent to a plurality of cells is selected therefor.

In the driving method of generating a sustain pulse exhibiting gentle rising as described above, unlike a conventional rectangular pulse exhibiting abrupt rising and falling, a micro-discharge is achieved by applying the cells of the panel with the sustain pulse exhibiting gentle rising.

This results in stable light emission even with variations in the discharge characteristic from one cell to another of the panel. In addition, the X-driver 211X eliminates a plurality of switching operations at a plurality of switching timings as is the case of the prior art, and instead operates at a single switching timing with a single switching device, so that the X-driver 211X provides a simplified configuration and lower power consumption. It should be noted that when the fly-back pulse output circuit drives a large-size panel to cause an increase in discharge current, the peak value of the sustain pulse may become unstable due to an insufficient capacitance of the resonance capacitor. In this event, the fly-back pulse output circuit may be additionally provided with a peak hold circuit and a peak voltage value detecting means to stabilize the peak value of the driving pulse by sequentially detecting the peak value of the driving pulse and adjusting the value of the supply voltage generated by a variable DC power source by a portion corresponding to the detected peak value. Furthermore, instead of adjusting the voltage value of the variable direct-current power source, a duty adjusting circuit may be further added to adjust the ratio of a connecting period to a breaking period, provided by the switching device, in accordance with a peak voltage value.

Next, the method of driving the plasma display panel 120 illustrated in FIG. 1 by means of the X-driver 211X appearing in FIG. 6 will be described with reference to FIG. 7.

Figure 7:
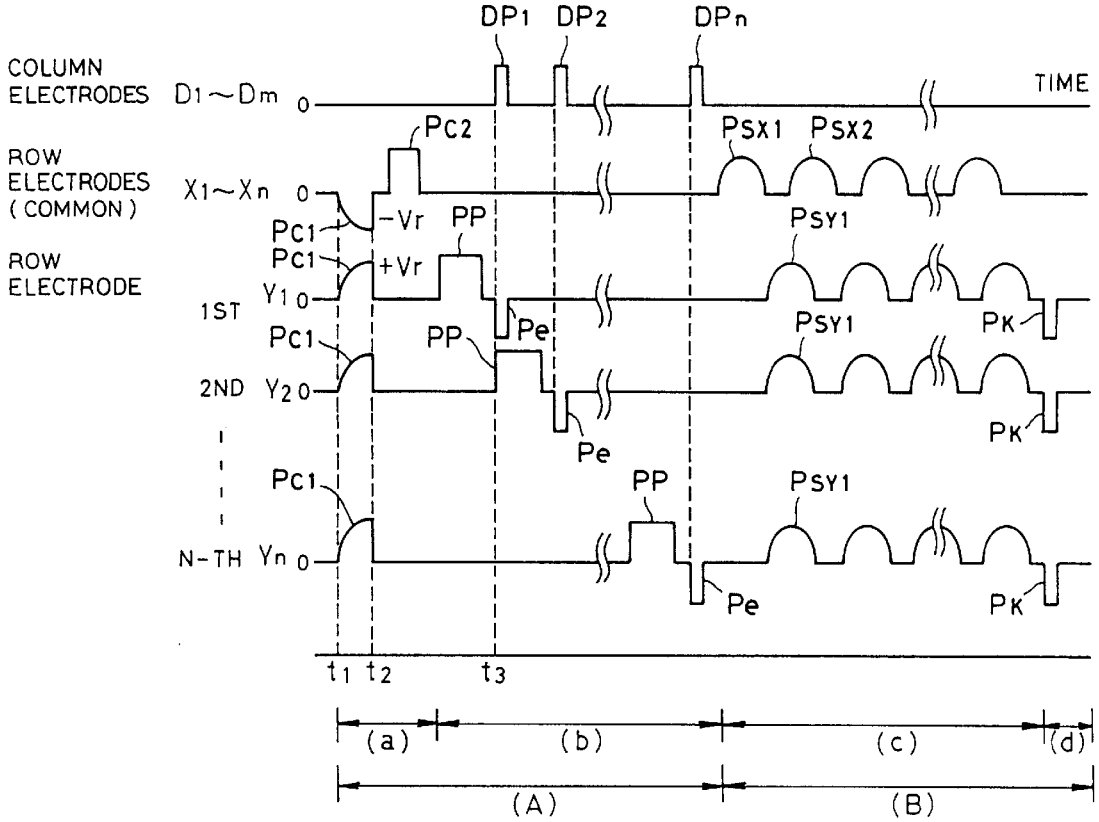
FIG. 7 is a timing chart showing timings at which a variety of pulses are applied to a plasma display panel in an embodiment of a method of driving a surface discharge AC plasma display device according to the present invention.

FIG. 7 illustrates timings at which a variety of pulses are applied to the plasma display panel 120 when it is driven.

Making a particular reference to one pixel cell Pi, j ($1 \leqq i \leqq n$, $1 \leqq j \leqq m$), the pixel cell Pi, j provides a dynamic display operation by repeating a sub-field which comprises a non-display period (A) including a pixel cell initialization period (a) and a next data write period (b), and a display period (B) including a discharge sustaining period (c) and a data erasure period (d).

In the period (a), wherein no pixel data is supplied to the pixel cell Pi, j, the row electrode driving pulse generator circuit 210 simultaneously supplies all row electrodes Xi, Yi of all row electrode pairs with a reset pulse Pc1 as a first predischarge pulse at time $t_1$. In this event, in each of the paired row electrodes Xi, Yi, one electrode Xi in the pair is supplied, for example, with a negative-polarity pulse having such a waveform that gradually falls from a leading edge and reaches a potential −Vr at a trailing edge, as a first sub-pulse, while the other electrode Yi is applied, for example, with a positive-polarity pulse, opposite to the first sub-pulse, having such a waveform that gradually rises from the leading edge and reaches a potential +Vr at the trailing edge as a second sub-pulse. As can be seen from FIG. 7, the first predischarge pulse ha a waveform which gradually falls. An associated cell starts discharging when a potential difference generated between paired row electrodes by these pulses exceeds the minimal discharge start voltage. This reset discharge, i.e., a predischarge, instantaneously terminates such that wall charges generated by the reset discharge substantially uniformly remain on the dielectric layer in all the pixel cells.

However, since the pulse gently or gradually falls at the leading edge, the magnitude of the predischarge produced by the first predischarge pulse Pc1 is smaller. The predischarge with a smaller magnitude is more likely to cause a reduced amount of generated wall charges in each pixel cell and a larger difference in the amount of generated wall charges in respective pixel cells over the entire panel.

To solve this problem, i.e., to generate a uniform amount of wall charges in respective pixel cells over the entire plasma display panel, the row electrode driving purse generator circuit 210 supplies one of the paired row electrodes, for example, the row electrodes Xi with a second predischarge pulse Pc2 having the polarity opposite to that of the first sub-pulse at time $t_2$ immediately after the first predischarge pulse has been applied in the period (a), to cause another predischarge to correct non-uniformity in the amount of wall charges generated in the respective pixel cells, thus enabling a uniform amount of wall charges to be generated in the respective pixel cells over the entire plasma display panel.

Next, in the period (b), a pixel data pulse generator circuit 212 sequentially applies the column electrodes D1–Dm with pixel data pulses DP1–DPn having positive voltages corresponding to pixel data of respective rows. The row electrode driving pulse generator circuit 210, in turn, supplies the row electrodes Y1–Yn with a scan pulse having a small pulse width, i.e., a data selection pulse Pe in synchronism with each application timing of the pixel data pulses DP1–DPn. In this event, immediately before supplying the respective row electrodes Yi with the scan pulse Pe, the row electrode driving pulse generator circuit 210 supplies one row electrode Yi, paired with the other row electrode Xi, with a priming pulse PP having the polarity opposite to that of the first sub-pulse Pc1, for example, the positive polarity, as shown in FIG. 7. For example, a pixel cell P1,j is supplied with a data pulse corresponding to associated pixel data at time $t_3$ to determine whether or not the pixel cell P1,j emits light.

As described above, the application of the priming pulse PP causes charged particles generated by the predischarges caused by the pulses Pc1 and Pc2 and reduced over time to be restored in the discharge space. Thus, when a desired amount of charged particles exists on the dielectric layers in the discharge space, pixel data can be written by applying the scan pulse Pe.

For example, for a selective erasure, if the contents of pixel data indicate that an associated pixel cell is prohibited from emitting light, the pixel data pulse DP and the scan pulse Pe are simultaneously applied to this pixel cell, so that wall charges formed inside the pixel cell are extinguished, thus determining that the pixel cell will not emit light during the period (c). On the other hand, if the contents of pixel data indicate that an associated pixel cell is permitted to emit light, the scan pulse Pe only is applied to the pixel cell so that a discharge is not produced, whereby wall charges formed inside the pixel cell are sustained as they are, thus ensuring that the pixel cell will emit light in the period (c). Stated another way, the scan pulse Pe serves as a trigger for selectively erasing wall charges formed within pixel cells in accordance with pixel data.

On the other hand, for a selective write, a pixel data pulse at logical "1" and a scan pulse Pe are simultaneously supplied to increase the wall charges, thus determining that the pixel cell will emit light in the next period (c).

Next, in the period (c), the row electrode driving pulse generator circuit 120 continuously supplies the respective row electrodes X1–Xn with a series of sustain pulses Psx having a positive voltage and also continuously supplies the respective row electrodes Y1–Yn with a series of sustain pulses Psy having a positive polarity at timings staggered from the timings at which the sustain pulses Psx are applied, to continue a light emitting discharge for a display operation corresponding to pixel data which have been written during the period (b). In this event, in each cell which holds wall charges generated therein during the preceding period (b), the sustain pulse is applied thereto to cause a discharge through a discharge gap between its paired row electrodes by charge energy possessed by the wall charges per se and energy of the sustain pulse, allowing the cell to emit light. In a cell which has wall charges extinguished, since a potential difference Vs generated in the cell by the sustain pulse applied thereto is lower than the discharge start voltage, the cell will not discharge and accordingly will not emit light.

It should be noted that in the sustaining discharge process, the sustain pulse Psx1 first applied to the row electrode has a pulse width larger than those of the sustain pulses Psy1, Psx2, . . . applied at second and subsequent times.

The reason for the different pulse widths will be next described. Since the data write into pixel cells using pixel data and scan pulses is performed sequentially from the first to the n-th rows, a time taken to enter the sustaining discharge process after pixel data is written into pixel cells is different from one row to another. Specifically, over the entire panel, even in a situation, for example, in which the pixel data has determined that wall charges are maintained in pixel cells, the amounts of wall charges and space charges inside pixel cells immediately before entering the discharge sustaining period (c) may be different from one row to another. It is therefore possible that the sustaining discharge is not produced in a pixel cell in which the amount of wall charges has been reduced as the time has passed from the writing of pixel data to the sustaining discharge. To avoid such a situation, the first sustain pulse having a larger pulse width is employed such that a potential difference generated by the application of the first sustain pulse can remain active between the paired row electrodes for a period longer than usual so as to ensure that the first sustaining discharge is produced in either of pixel cells which have been selected to emit light for the display operation and to provide a uniform amount of charges in the pixel cells selected to emit light over the entire panel. The first sustaining discharge thus produced by the sustain pulse having a larger pulse width enables a uniform image to be displayed over the entire panel.

Next, in the period (d), as the row electrode driving pulse generator circuit 210 simultaneously applies an erasure pulse Pk to all the row electrodes Y1–Yn, the sustaining discharges in the respective cells are stopped to erase all pixel data which have been written into pixel cells during the period (b).

Thus, in a pixel cell, the reset pulse is applied between the paired row electrodes Xi, Yi for initialization to cause a reset discharge centered on the discharge gap G1 as a predischarge in the period (a). Next, in the period (b), pixel data are written into cells to select cells which emit light. In the period (c), a cell which has been selected to emit light based on the pixel data written thereinto in the period (c) is periodically applied with the sustain pulse to the paired row electrodes thereof to sustain a light emitting condition for display. In the period (d), the erasure pulse is applied to one row electrode of the paired row electrodes to erase the written data.

As described above, in the method of driving the plasma display panel according the present invention, all row electrodes are simultaneously supplied with the first predischarge pulse having a waveform which gently or gradually rises for initialization, the sustain pulse applied first to the row electrodes is provided with a wider pulse width in the sustaining discharge process, and the sustain pulse exhibiting gentle rising is applied, thereby driving the panel to emit light for display.

By thus providing the sustain pulse having a gently or gradually rising waveform, respective cells can discharge near their respective minimal discharge sustaining voltages, thus realizing stably micro-discharges. In addition, with the first predischarge pulse having a waveform which gradually rises, the luminance of light emitted from a pixel cell by a predischarge can be limited to a low level. Furthermore, since the first sustain pulse has a pulse width wider than that of the second and subsequent sustain pulses to ensure that the sustaining discharge occurs in pixel cells, the amounts of charges existing in respective pixel cells are substantially uniform for the same pixel data over the entire panel, thus making it possible to precisely emit light for display.

In the foregoing driving method, if a lower voltage or a shorter pulse width of the reset pulse results in an insufficient reset discharge in the initialization taking place during the period (a), a smaller amount of wall charges only is generated by such a reset discharge, wherein the wall charges mainly concentrate near the discharge gap.

In the subsequent period (b), when data indicative of a selective erasure is written, a selective discharge takes place in accordance with the data to extinguish wall charges existing near the discharge gap. In this event, since the wall charges to be erased only exist near the discharge gap and the amount of charges is small, the wall charges in a selected pixel cell can be substantially completely extinguished even if the pulse having a lower voltage or a narrower pulse width is applied for the selective discharge. In other words, it is possible to suppress the intensity of light emitted by a discharge which is not related to display.

In the subsequent period (c), even if the sustain pulse is applied, no discharge is produced in a pixel cell in which wall charges have been extinguished by the selective discharge, so that the pixel cell does not emit light. On the other hand, the application of the sustain pulse produces a discharge in a pixel cell in which no selective discharge has occurred and therefore wall charges still remain, causing the pixel cell to start light emission.

In addition, since the plasma display device of the present invention is of a surface discharge type, it is also necessary to take into consideration the distribution of wall charges near the electrodes. In an equilibrium state of a sustaining discharge, the amount of wall charges extensively distributes over entire regions around the row electrodes Xi, Yi on the dielectric layer. Thus, if the wall charges exist only near the discharge gap and its amount is less than the wall charges in the equilibrium state, the distribution of the wall charges gradually extends in a direction away from the discharge gap G1, i.e., toward the bus electrodes as the discharge is repeated. In this event, the intensity of light emitted from the pixel cell becomes gradually higher conforming to the amount of generated charges, and eventually reaches a fixed level.

Figure 1:
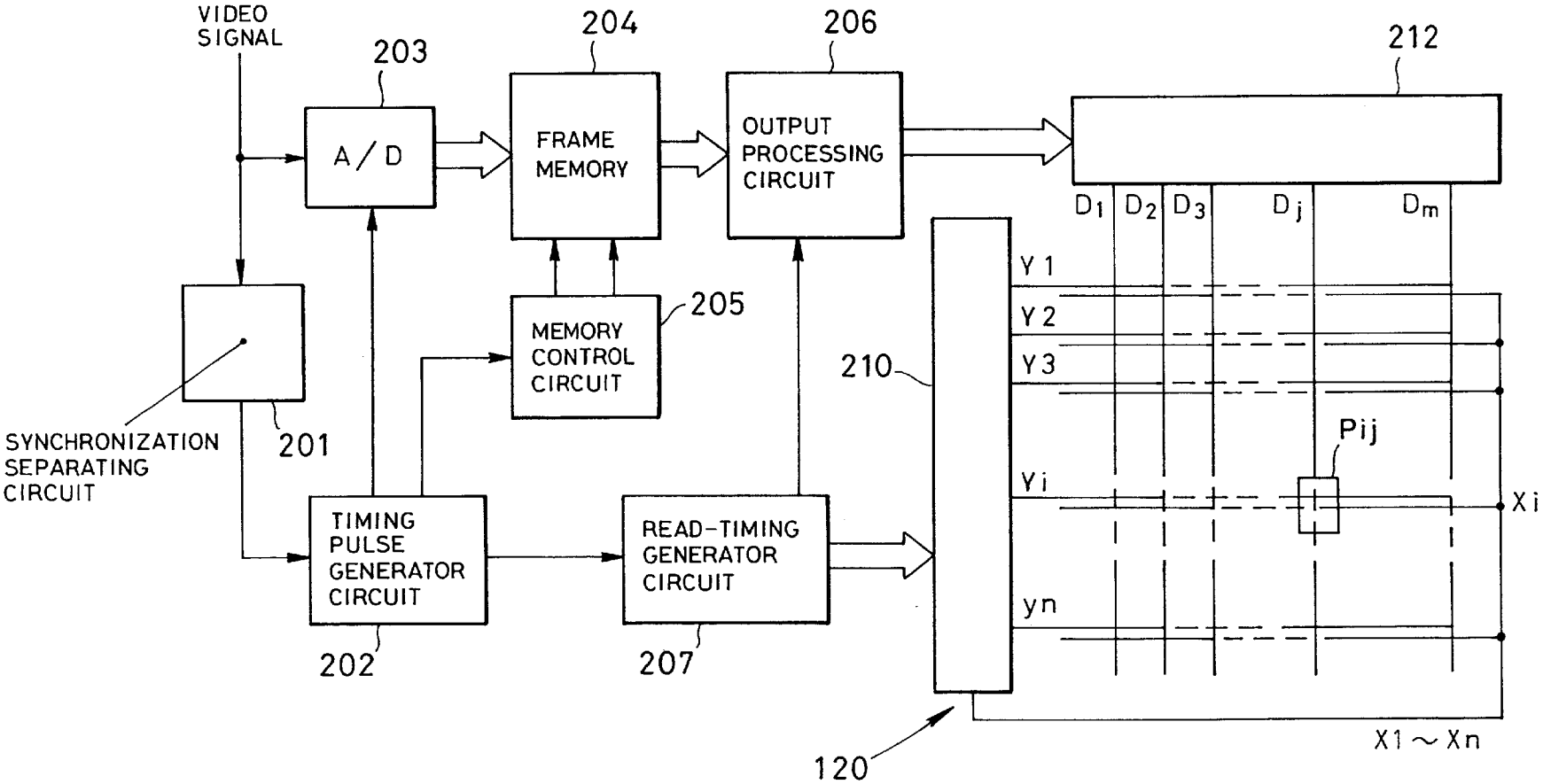
FIG. 1 is a block diagram illustrating a driver for use in a surface discharge AC plasma display device.
Figure 2:
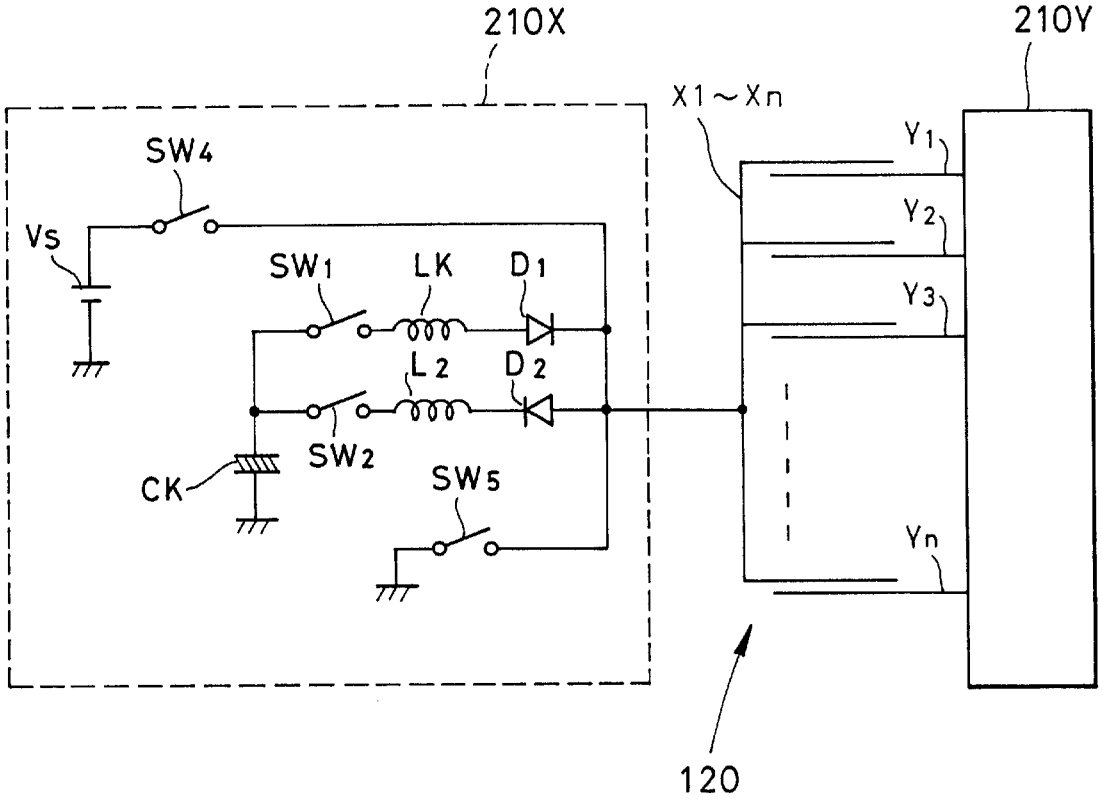
FIG. 2 is a schematic circuit diagram illustrating a row electrode driving pulse generator circuit in a driver for use with a surface discharge AC plasma display device.
Figure 3A:
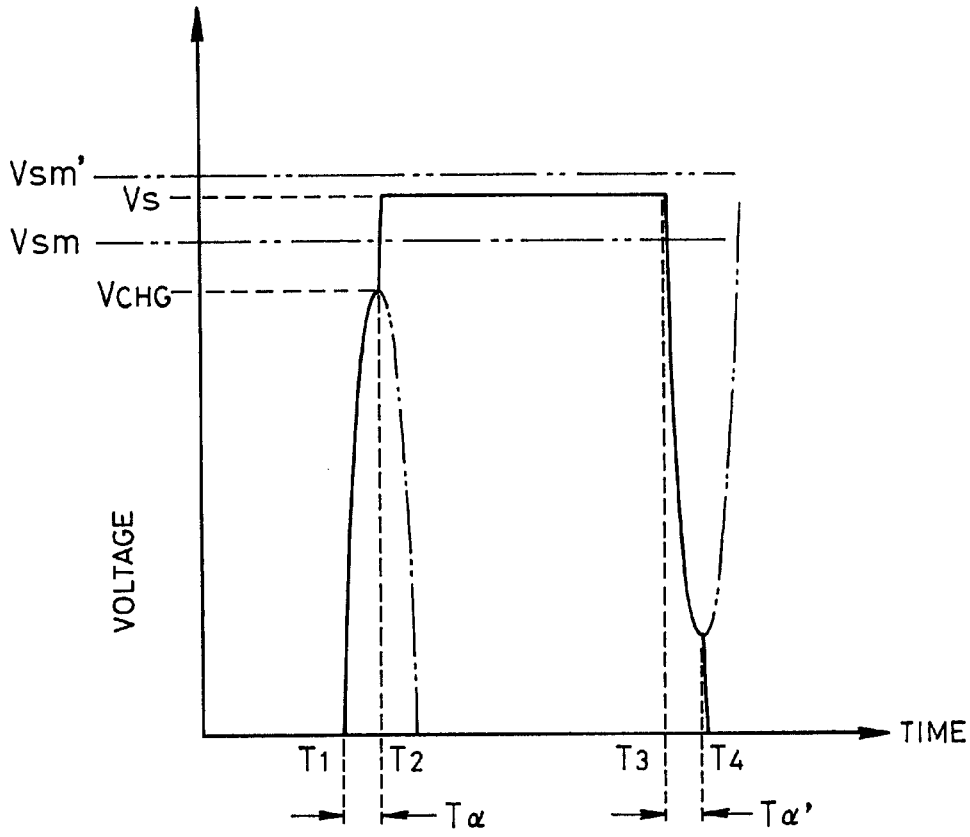
FIGS. 3A and 3B are diagrams illustrating a charging voltage waveform of a sustain pulse applied to a row electrode and a corresponding change in the luminance of light emitted from a cell in a conventional method of driving a plasma display device respectively.
Figure 3B:
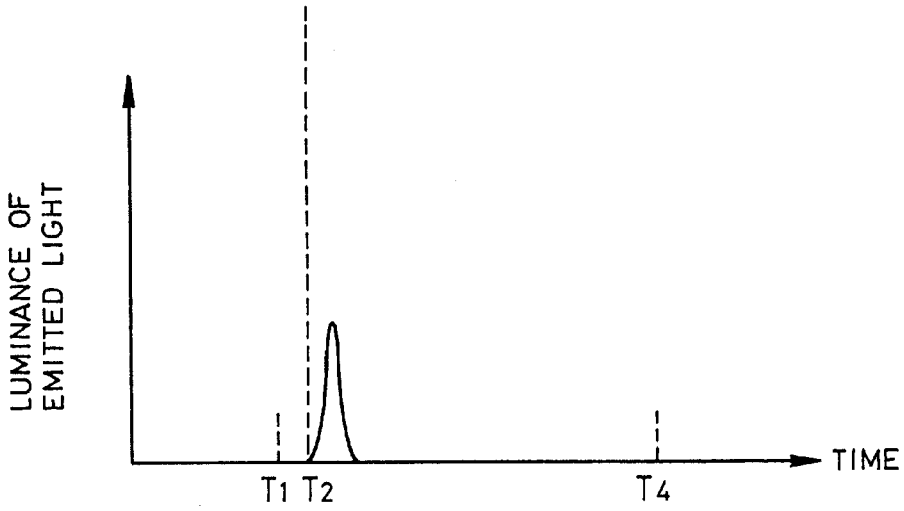

Thus, since the pair of row electrodes Xi, Yi arranged on both sides of the discharge gap in the plasma display panel 120 illustrated in FIG. 1, through which the reset discharge, the selective discharge and the sustaining discharge occur, has a total length larger than the width of the bus electrode and an enlarged area, wall charges gradually spread in a direction away from the discharge gap by repeated sustaining discharges, and eventually spread over the entire row electrodes Xi, Yi to reach an equilibrium state. Thus, a sustaining discharge extensively occurs over the entire paired row electrodes Xi, Yi in the equilibrium state, and the pixel cell emits light which is ultraviolet rays emitted from a discharge region remaining in the equilibrium state. As a result, the entire row electrodes Xi, Yi appear to emit light in the pixel cell Pi,j, when viewed from the display plane side.

The number of pulses required to allow the wall charges to spread over the entire row electrodes, i.e., to bring the wall charges in the equilibrium state, during the period (c), is several times. Since the sustain pulse is applied approximately several tens to several hundreds of times in each sub-frame, the wall charges will substantially instantaneously reach the equilibrium state as the period (c) of the sub-frame is entered, wherein the entire row electrodes in each pixel cell appear to emit light when viewed from the display plane side. It will be appreciated from the foregoing that even an insufficient reset discharge will never affect the luminance of light emitted from pixel cells during display.

Since the configuration of paired row electrodes Xi, Yi in the plasma display panel 120 illustrated in FIG. 1 results in an increase in the intensity of light emission through the sustaining discharge, the plasma display panel can be improved in terms of contrast.

As described above, the method of driving a plasma display device according to this embodiment employs the sustain pulse which has the waveform exhibiting gentle rising or falling at a leading edge thereof, as compares with a scan pulse. Further, in this embodiment, a stable micro-discharge can be achieved by limiting the sustaining discharge in a region near a discharge gap formed between the paired row electrodes within a unit light emitting region, i.e., by reducing the ratio of the field strength on the bus electrode to the field strength in a discharging region (leading ends of discharge electrodes) of the panel.

Description will next be made on a method of limiting the sustaining discharge in a region near a discharge gap in the plasma display panel of the structure described above.

Figure 8:
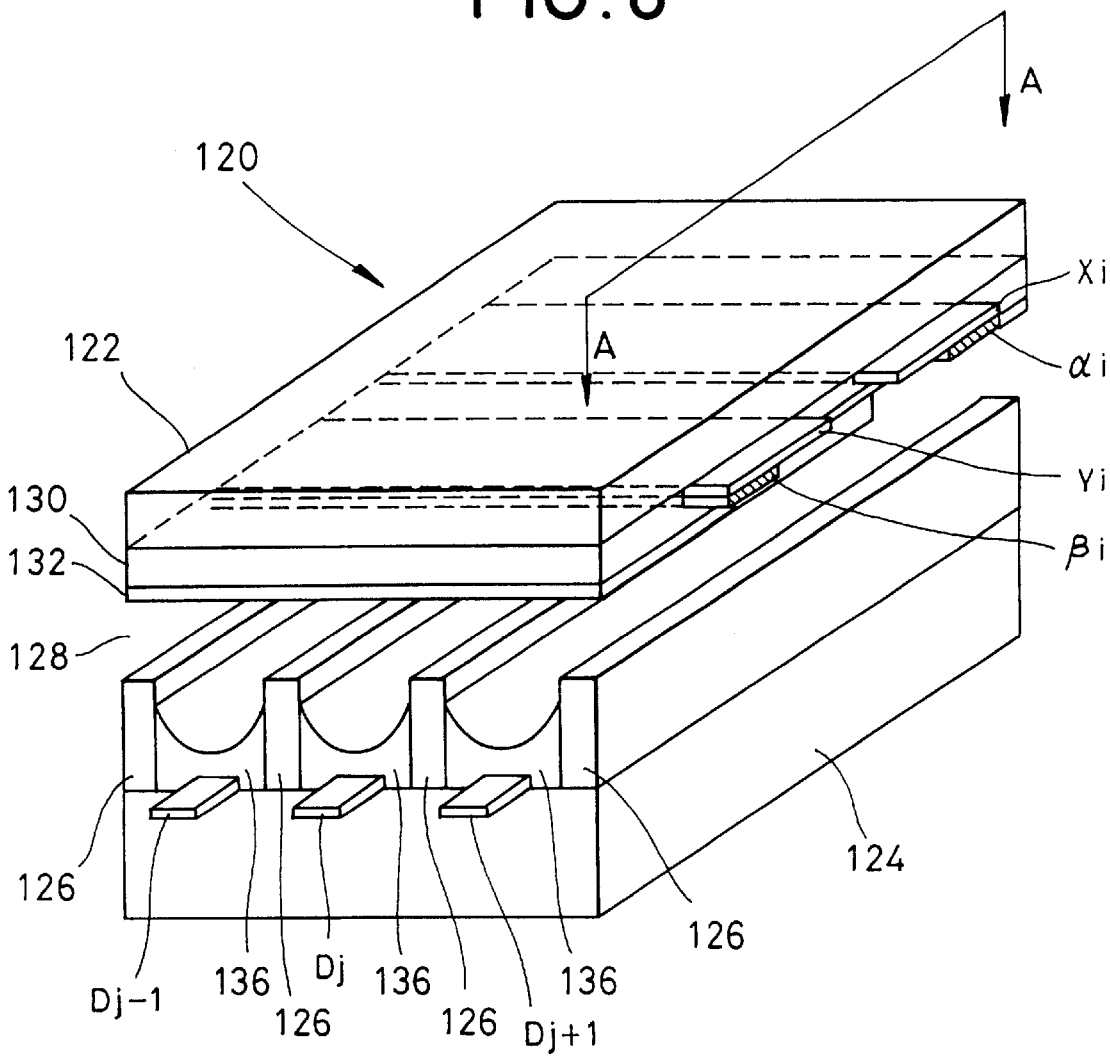
FIG. 8 is a perspective view schematically illustrating a pixel cell in a surface discharge AC plasma display device.

FIG. 8 illustrates one of a plurality of pixel cells constituting a surface discharge AC plasma display panel 120 of an embodiment which employs a three-electrode structure. In this type of plasma display panel, two substrates, i.e., a front glass substrate 122 and a back glass substrate 124, are positioned opposite to each other with a predetermined gap e.g., 100–200 $\mu$m intervening therebetween. A plurality of barrier ribs 126, 126 are formed in parallel with and adjacent to each other in order to define a discharge space 128.

On an inner surface (i.e., a surface opposite to the back glass substrate) of the front glass substrate 122 serving as a display plane displaying an image , a plurality of paired row electrodes Xi, Yi (i=1,2, . . . ,n) extending in parallel, are formed as paired sustain electrodes. Each of the row electrodes Xi, Yi is composed of a transparent electrode formed of such as indium tin oxide (ITO) or tin oxide (SnO) at several hundreds nanometer thick by the vacuum deposition. Metal bus electrodes $\alpha$i and $\beta$i are formed on the transparent electrodes as auxiliary electrodes respectively. A dielectric layer 130 is formed in a predetermined thickness ranging from 20 to 30 $\mu$m so as to overlay these row electrodes Xi, Yi, and an MgO layer 132 is formed directly on the dielectric layer 130 in a predetermined thickness of several hundreds nanometer order.

Figure 9:
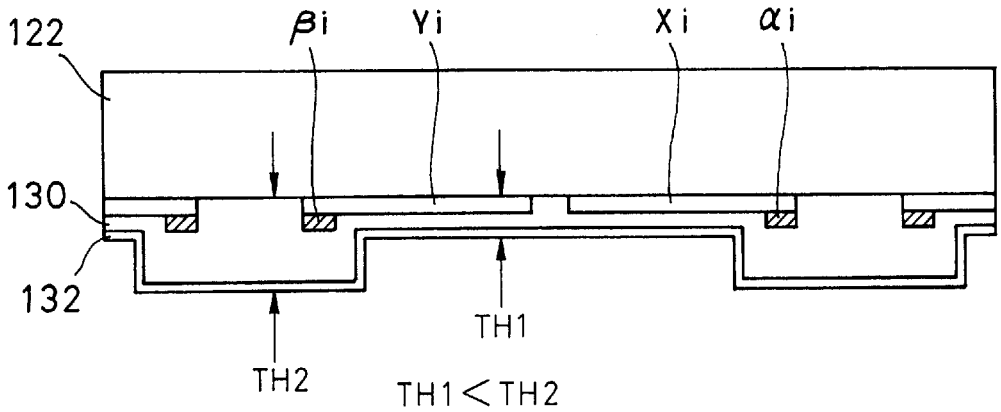
FIG. 9 is a partial enlarged cross-sectional view taken with line AA of FIG. 8 illustrating a front substrate of a surface discharge AC plasma display device according to an embodiment of the present invention.

FIG. 9 illustrates a partial enlarged cross-sectional view of a front substrate 122. As can be seen, this embodiment employs an uneven-thickness or raised dielectric structure in which a dielectric thickness distribution is defined within a cell such that a dielectric layer is thicker on bus electrodes and thinner near a discharge gap. This allows the sustaining discharge to be limited only in a region near the discharge gap. Since a wall charge in a thinner dielectric layer portion TH1 is larger than a wall charge in each thicker dielectric layer portion TH2, the field strength is smaller on the bus electrodes than on the discharge gap, so that the region of the sustaining discharge is prevented from extending onto the bus electrodes, thereby making it possible to limit the sustaining discharge only near the discharge gap.

On the back substrate 124, on the other hand, barrier ribs 126 provided to hold the gap between the back substrate 124 and the front substrate 122 are formed, for example, using a thick film printing technique in parallel with each other such that their longitudinal direction extends in a direction orthogonal to the row electrodes Xi, Yi to have a width of 50 $\mu$m and an interval of 400 $\mu$m therebetween, by way of example. It should be noted that the interval between the barrier ribs 126 is not limited to 400 $\mu$m, but may be modified to any appropriate value in accordance with the size, the number of pixels, and so on of a particular plasma display panel serving as a display surface.

Further, between the adjacent barrier ribs 126, column electrodes Dj (j=1,2, . . . , m) made, for example, of aluminum or aluminum alloy are formed as address electrodes in a thickness of approximately 100 nm in a direction orthogonal to the direction in which the row electrodes Xi, Yi extend. Since the column electrodes Dj are made of a highly reflective metal such as Al, Al alloy or the like, the column electrodes Dj have a reflectivity of 80% or more in a wavelength band ranging from 380 to 650 nm. It should be noted that the column electrodes Dj are not limited to Al or Al alloy, but may be made of any appropriate metal or alloy having a high reflectivity such as Cu, Au, or the like.

A fluorescent layer 136 is formed overlaying the respective row electrodes Dj as a light emitting layer in a thickness ranging from 10 to 30 $\mu$m, by way of example.

The front substrate 122 and the back substrate 124, on which the respective electrodes Xi, Yi, Dj, the dielectric layer 130 and the light emitting layer 136 have been formed as described above, are air-tight bonded, discharge spaces 128 are evacuated, and moisture is removed from the surface of an MgO layer 132 by baking. Next, an inert gas mixture including, for example, 3 to 7% of Ne·Xe gas as rare gas is filled in the discharge spaces 128 at a pressure ranging from 400 to 600 torr and sealed hermetically therein.

Next, description will be made on the shape and dimensions of the row electrodes Xi, Yi.

Figure 10:
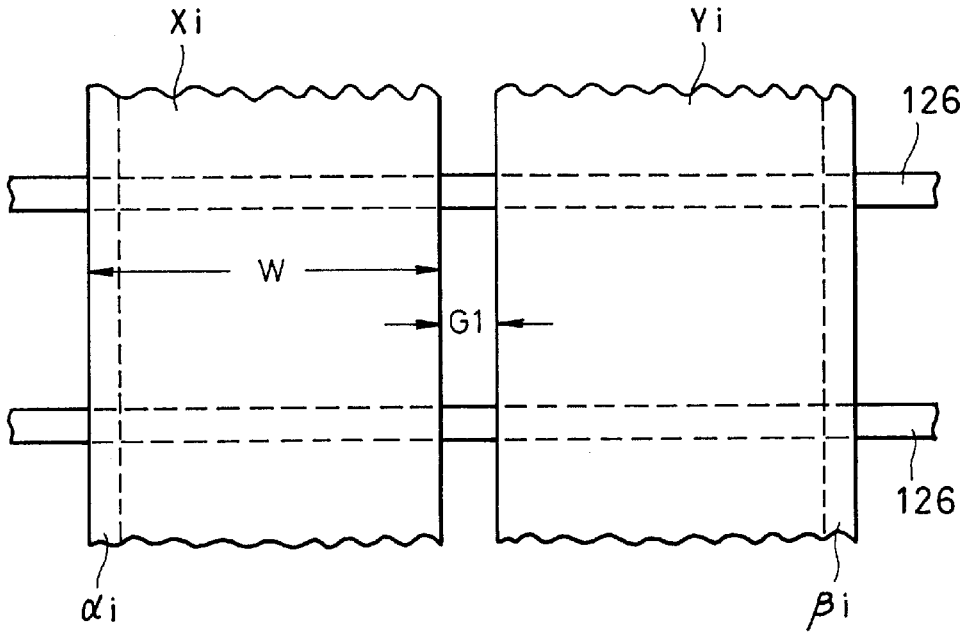
FIGS. 10 to 15 are top plan views each illustrating row electrodes on a front substrate of a surface discharge AC plasma display device according to another embodiment of the present invention.

FIG. 10 illustrates an embodiment of the structure for the paired row electrodes Xi, Yi. As described above, the paired row electrodes Xi, Yi are formed opposite to each other to extend in parallel with each other with a predetermined distance intervening therebetween. In this embodiment, each of the paired row electrodes Xi, Yi has an appropriate thickness and a width w, i.e., the distance from the trailing edge of an associated bus electrode to the opposite edge of the row electrode, equal to or more than 300 $\mu$m. The width "w" of the row electrodes Xi, Yi may be of any value as long as it is 300 $\mu$m or more. Since a bus electrode is formed twice the length of 300 $\mu$m or more away from each row electrode in a cell, the distance between the discharge gap and the bus electrode can be made larger, thus reducing the ratio of field strength on the bus electrode to that on the discharge gap. Further, the row electrodes may be formed to fully extend over the interval between the adjacent barrier ribs 126 in a unit light emitting region. A gap G1 between the paired row electrodes Xi, Yi in a pixel cell serves as a discharge gap.

Figure 11:
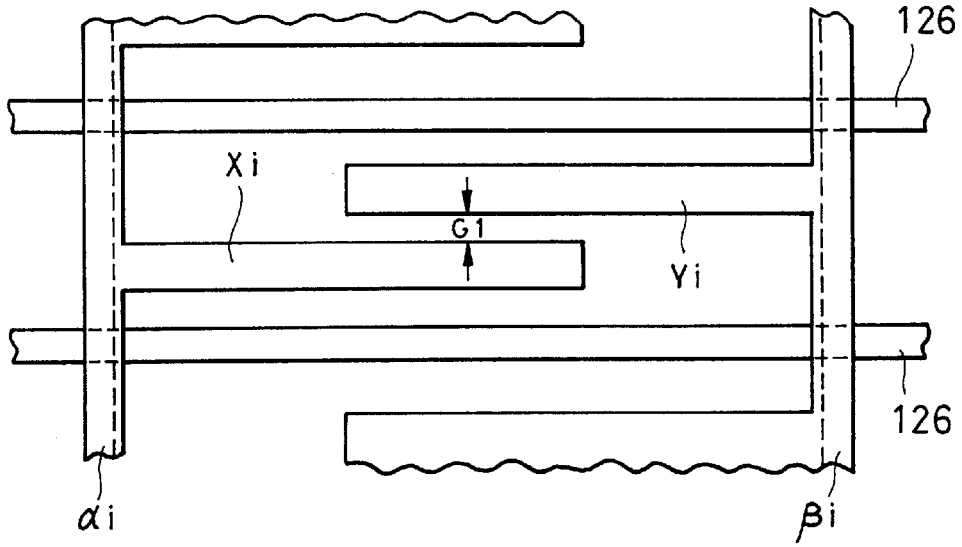

FIG. 11 illustrates another embodiment of the structure for the paired row electrodes Xi, Yi. Branches 101 of the paired row electrodes Xi, Yi are formed opposite to each other to extend from associated bus electrodes in parallel with each other with a predetermined distance intervening therebetween, so that a discharge gap G1 is positioned between longitudinal side surfaces of the two branches. Stated another way, each of the row electrodes consists of a main portion 100 extending in the horizontal direction, and a protrusion 101 protruding vertically from the main body 100 to face the protrusion 101 of the other row electrode in the pair in each unit light emitting region. In this way, the direction in which the discharge gap G1 extends between the two row electrodes, through which discharge should occur, is deviated from the direction in which the main portion 100 extends, so that these directions are perpendicular to each other, and the protrusion 101 is formed such that the discharge gap is formed in the horizontal direction. This effectively prevents the discharge extending from the discharge gap G1 from reaching any bus electrode.

Figure 12:
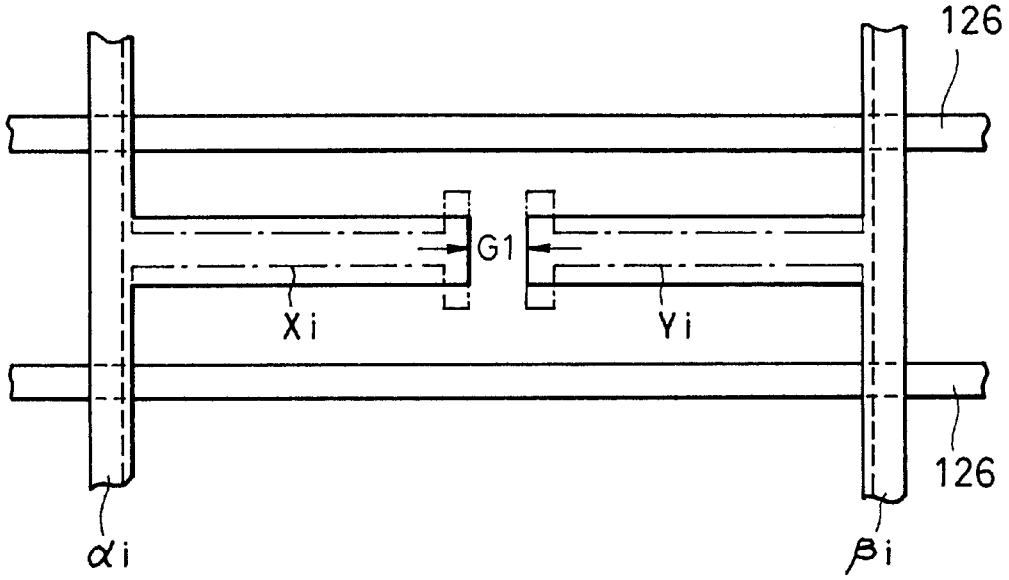

FIG. 12 illustrates a yet another embodiment of the structure for the row electrodes Xi, Yi. Discharge electrodes are separated for each cell, i.e., for each interval between adjacent barrier ribs 126, with branches 101 of the paired row electrodes Xi, Yi being formed opposite to each other to extend in parallel with each other with a predetermined distance maintained from associated bus electrodes. In other words, the protrusions 101 are formed such that a discharge gap G1 extends in the vertical direction. This can prevent an erroneous discharge as well as limit the extent of a discharge within a region "s" near the discharge gap G1. The row electrodes Xi, Yi may be implemented, for example, as rectangular electrodes as indicated by solid lines or as T-shaped electrodes as indicated by one-dot chain lines.

Figure 13:
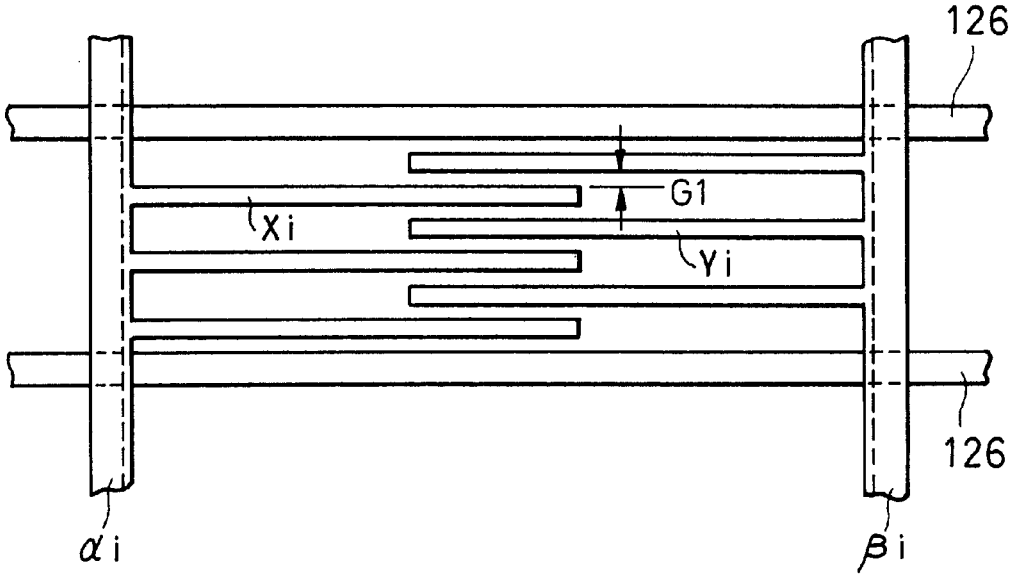
Figure 14:
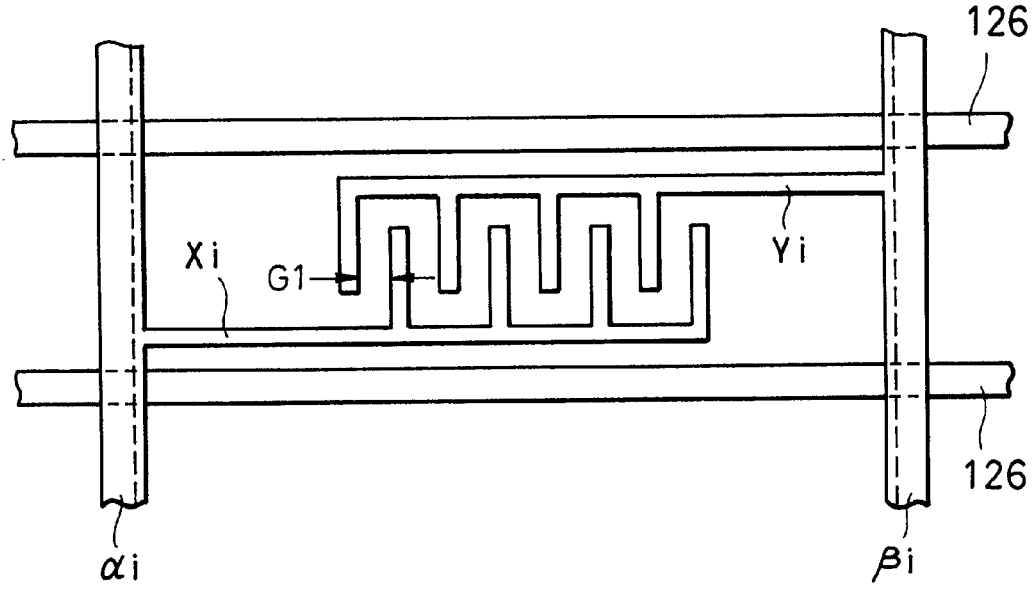

FIGS. 13 and 14 illustrate still other embodiments of the structure for the paired row electrodes Xi, Yi. Discharge electrodes are separated for each cell, and a plurality of discharge electrodes are formed with branches which interdigitally extend in parallel with each other and opposite to each other with a predetermined distance intervening therebetween. Thus, a cell is provided with a plurality of discharge regions, where the direction in which discharge gaps G1 extend is deviated from the direction in which the spacing between both bus electrodes extends, so that these directions are defined perpendicular to each other (FIG. 13) or in parallel with each other (FIG. 14). This effectively prevents the discharge extending from the discharge gap G1 from reaching any bus electrode as well as improves the luminance of emitted light.

Figure 15:
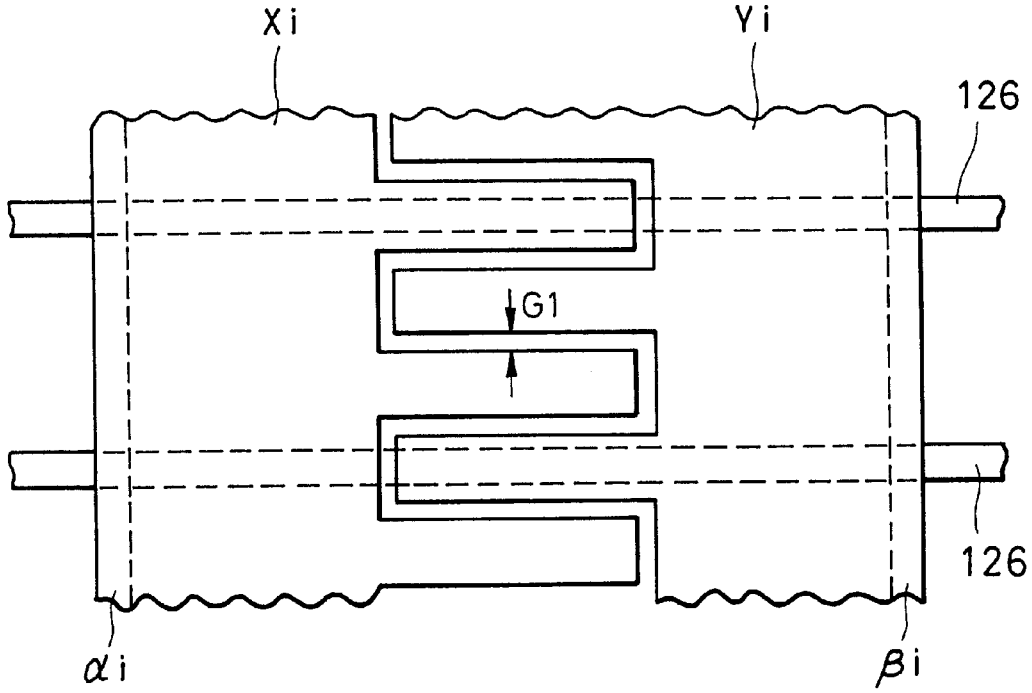

FIG. 15 illustrates another embodiment of the structure for the paired row electrodes Xi, Yi. Branches of the paired electrodes Xi, Yi are formed opposite to each other to extend in parallel with each other with a predetermined distance spaced from a bus electrode, so that a meander discharge gap G1 is provided. Since the two row electrodes, between which discharge should occur, faces each other over a longer distance, the luminance of emitted light can be improved.

Figure 16:
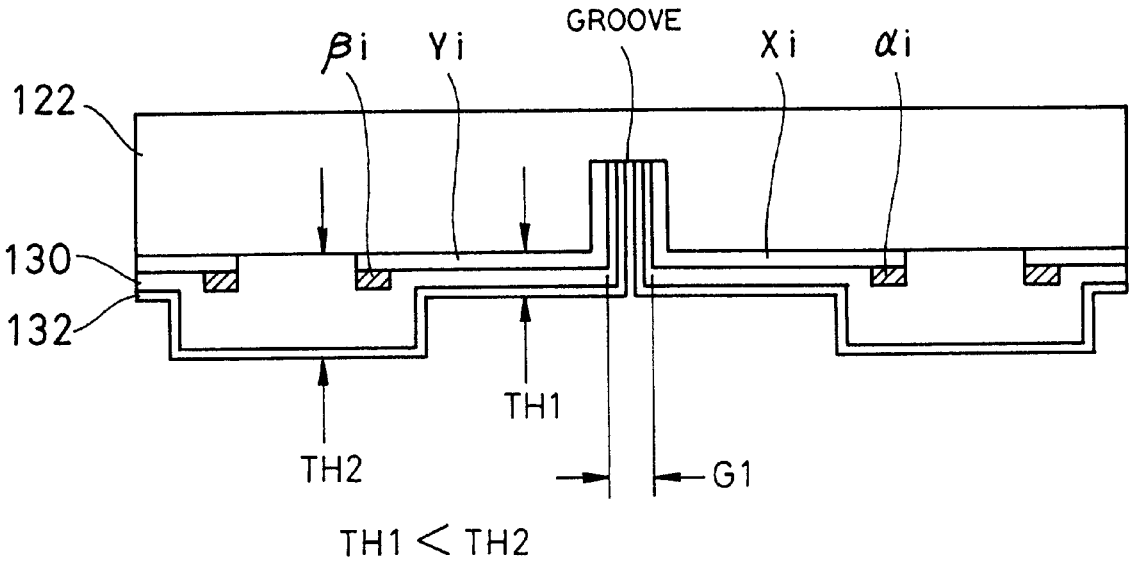
FIG. 16 is a partial enlarged cross-sectional view similar to FIG. 9 illustrating a front substrate of a surface discharge AC plasma display device according to anther embodiment of the present invention.

FIG. 16 illustrates a yet further embodiment of the structure for the paired row electrodes Xi, Yi with $\alpha i$, $\beta i$. A groove is formed directly in a glass substrate 122 or in a glass intermediate layer disposed on the glass substrate 122. Then, row electrodes are formed extending along side surfaces of the groove, and a dielectric layer 130 and a MgO layer 132 are formed in turn thereon. Regions of the paired row electrodes Xi, Yi near a discharge gap G1 are formed to face each other through a discharge space 128. This enables an opposing discharge only between discharge electrodes at a lower voltage. It is therefore possible to prevent the discharge extending from the discharge gap G1 from reaching any bus electrode.

A more stabilized micro-discharge can be achieved at a low voltage by driving a cell employing any of the foregoing structures for a plasma display panel with a pulse exhibiting gentle rising, thereby making it possible to simultaneously improve the light emitting efficiency through a limited discharge region and low voltage driving and ensure a display margin.

What is claimed is:

1. A plasma display device for displaying an image comprising:

a plasma display panel including a plurality of row electrodes formed in pairs and extending in parallel with each other in the horizontal direction, a plurality of column electrodes extending in the vertical direction and facing said paired row electrodes with a discharge space intervening therebetween to form unit light emitting regions at respective intersections with said paired row electrodes, and a dielectric layer for covering up said paired row electrodes with respect to said discharge space;

means for applying a scan pulse to every pair of row electrodes and simultaneously applying a pixel data pulse to every column electrode to select light emitting pixels and non-light emitting pixels during an addressing period; and means for applying a series of sustain pulses alternately to one of the row electrode pair and the other thereof to sustain discharges for said light emitting pixels and said non-light emitting pixels during a discharge sustaining period, wherein each of said sustain pulses has a waveform exhibiting gentle rising or falling at a leading edge thereof, as compared with said scan pulse, whereby limiting each of said sustaining discharges in a region near a discharge gap formed between paired row electrodes within said unit light emitting region, wherein said means for applying the sustain pulses comprises:

a DC power source for generating DC voltage having a positive side and negative side terminals;

a first capacitor connected in parallel with said DC power source;

a coil having a first end connected to the positive side terminal of said DC power source and a second end opposite thereto;

switching means for alternately performing a connection and a disconnection between the second end of said coil and the negative side terminal of said DC power source;

a diode having a cathode connected to the second end of said coil and an anode connected to the negative side terminal of said DC power source; and a second capacitor connected in parallel with said diode, wherein said coil outputs the sustain pulse at the second end thereof in accordance with an operation of said switching means.

2. A plasma display device according to claim 1, wherein a protruding surface portion is formed on said dielectric layer to protrude relative to the remaining surface portion of said dielectric layer, said protruding portion being positioned on an edge portion of said row electrode on the side opposite to said discharge gap, whereby further limiting each of said sustaining discharges in a region near a discharge gap formed between paired row electrodes within said unit light emitting region.

3. A plasma display device according to claim 1, wherein each of said row electrodes is formed with a width equal to or more than 300 $\mu$m within said unit light emitting region, whereby further limiting each of said sustaining discharges in a region near a discharge gap formed between paired row electrodes within said unit light emitting region.

4. A plasma display device according to claim 1, wherein each of said paired row electrodes includes a main portion extending in the horizontal direction, and a protrusion protruding from said main portion in the vertical direction so as to face a protrusion of the other row electrode forming a pair, with a discharge gap intervening therebetween, in each of said unit light emitting regions, whereby further limiting each of said sustaining discharges in a region near a discharge gap formed between paired row electrodes within said unit light emitting region.

5. A plasma display device according to claim 4, wherein said protrusions are formed such that said discharge gap is formed in the horizontal direction.

6. A plasma display device according to claim 4, wherein said protrusions are formed such that said discharge gap is formed in the vertical direction.

7. A plasma display device according to claim 1, wherein said regions of the respective row electrodes in said paired row electrodes near said discharge gap are formed opposite to each other face to face with said discharge space intervening therebetween, whereby further limiting each of said sustaining discharges in a region near a discharge gap formed between paired row electrodes within said unit light emitting region.

8. A plasma display device according to claim 1, wherein a change rate of the voltage value gently increasing of said sustain pulse in said unit light emitting region is 50 volts or less per microsecond.

* * * * *